US007992362B2

(12) United States Patent
Petta

(10) Patent No.: US 7,992,362 B2
(45) Date of Patent: Aug. 9, 2011

(54) COLUMN ASSEMBLY

(75) Inventor: Gabriel Petta, Woodbridge (CA)

(73) Assignee: Alpa Lumber Inc., Mississauga (CA)

( * ) Notice: Subject to any disclaimer, the term of this patent is extended or adjusted under 35 U.S.C. 154(b) by 259 days.

(21) Appl. No.: 12/398,747

(22) Filed: Mar. 5, 2009

(65) Prior Publication Data

US 2010/0205901 A1 Aug. 19, 2010

(51) Int. Cl.
*E04C 3/00* (2006.01)

(52) U.S. Cl. ..... 52/848; 52/844; 52/849; 52/855; 52/301

(58) Field of Classification Search ..... 52/835, 52/834, 843, 844, 845, 848, 849, 855, 832, 52/300, 301
See application file for complete search history.

(56) References Cited

U.S. PATENT DOCUMENTS

| | | | | | |
|---|---|---|---|---|---|
| 3,381,427 | A * | 5/1968 | Watson | 52/98 |
| 3,421,269 | A * | 1/1969 | Medow | 52/86 |
| 5,335,471 | A | 8/1994 | Kupiec | |
| 5,555,696 | A * | 9/1996 | Morrison et al. | 52/309.1 |
| 5,560,159 | A * | 10/1996 | Pennypacker | 52/126.1 |
| 5,568,709 | A | 10/1996 | Steckler | |
| 5,605,023 | A * | 2/1997 | Biernazki | 52/301 |
| 5,692,351 | A * | 12/1997 | Morrison et al. | 52/301 |
| 5,934,035 | A * | 8/1999 | Rasmussen et al. | 52/300 |
| 5,946,880 | A * | 9/1999 | Morrison et al. | 52/309.1 |
| 6,009,683 | A | 1/2000 | Grewe et al. | |
| 6,065,268 | A * | 5/2000 | Gump | 52/834 |
| D430,312 | S * | 8/2000 | Beachy | D25/126 |
| 6,098,353 | A * | 8/2000 | Stanfield | 52/170 |
| 6,305,670 | B1 * | 10/2001 | Ward et al. | 256/59 |
| 7,243,473 | B2 * | 7/2007 | Terrels | 52/843 |
| 7,455,282 | B2 * | 11/2008 | Platt | 256/59 |
| 7,621,080 | B2 * | 11/2009 | Stanfield | 52/170 |
| 2003/0101679 | A1 * | 6/2003 | Erwin | 52/736.3 |

OTHER PUBLICATIONS

Royal Crown Limited, 7" Square Porch Column Installation Instructions.

* cited by examiner

*Primary Examiner* — Robert J Canfield
*Assistant Examiner* — Brent W Herring
(74) *Attorney, Agent, or Firm* — Bereskin & Parr LLP/S.E.N.C.R.L, s.r.l.

(57) ABSTRACT

A kit of parts for a column assembly includes a sleeve having a first end portion, and a second opposed end portion. The kit further includes a collar having a collar aperture therethrough for receiving the first end portion of the sleeve in sliding fit. The kit further includes a skirt having skirt a first end and a skirt second end opposed to the skirt first end. A skirt aperture extends through the skirt for receiving the first end portion of the sleeve in sliding fit to position the skirt second end is adjacent the collar. A base is positionable adjacent the first end portion. The collar is selectively securable to the either the base or the skirt second end, and the skirt first end is selectively securable to the base, such that the column assembly is selectively assemblable with or without the skirt.

12 Claims, 8 Drawing Sheets

COLUMN ASSEMBLY

This application claims priority from Canadian Patent Application No. 2,651,442 filed on Feb. 13, 2009, which is hereby incorporated herein by reference.

FIELD

The specification relates to columns. More specifically, the specification relates to modular column assemblies used in the construction of houses and/or other buildings

INTRODUCTION

The following is not an admission that anything discussed below is prior art or part of the common general knowledge of persons skilled in the art.

Columns are used in the construction industry to provide structural support or aesthetic benefits to buildings.

Royal Crown Limited of Milford Ind. sells a modular column assembly. The assembly includes two trim collars, two sleeves, a column, and two mounting plates. The column assembly is assembled by securing each trim collar to a sleeve by screwing the trim collar to the sleeve from the interior of the sleeve. The sleeves are then secured to the column by inserting either end of the column into a sleeve and screwing the sleeves to the column from the interior of the column. The column is then attached to the mounting plates by screwing the mounting plates to the ends of column from the underside of the mounting plates. The assembly is then set in place, and the mounting plates are secured to the floor or ceiling using screws.

SUMMARY

The following summary is provided to introduce the reader to the more detailed discussion to follow. The summary is not intended to limit or define the claims.

The present disclosure provides a modular column assembly that provides flexibility in customizing the appearance of the assembly. For example, a kit of parts may be provided that includes a collar, a skirt, a sleeve, and a base. A user may optionally assemble the assembly using the collar, the skirt, the sleeve, and the base, or using only the collar, the sleeve, and the base.

Further, the present disclosure provides a modular column assembly that is relatively easy to assemble. For example, some or all of the parts may be snapped together.

According to one broad aspect, a kit of parts for a column assembly is provided. The kit of parts comprises a sleeve comprising a first end portion, and a second opposed end portion. A collar comprises a collar aperture therethrough for receiving the first end portion of the sleeve in sliding fit. A skirt comprises skirt a first end and a skirt second end opposed to the skirt first end. A skirt aperture extends through the skirt for receiving the first end portion of the sleeve in sliding fit to position the skirt second end adjacent the collar. A base is positionable adjacent the first end portion. The collar is selectively securable to the either the base or the skirt second end, and the skirt first end is selectively securable to the base, such that the column assembly is selectively assemblable with or without the skirt.

In some examples, the collar comprises a collar fastener, the base comprises a base fastener, and the collar fastener is engageable with the base fastener to secure the collar to the base. The collar fastener may comprise a collar tab, the base fastener may comprise a base slot, and the collar tab may be insertable into the base slot to secure the collar to the base.

In some examples, the kit may comprise a connector for securing the skirt first end to the base. The skirt first end may comprise a skirt first end screw port, the base fastener may comprise a base screw port; and the connector may comprise a screw insertable through the skirt first end screw port and the base screw port.

In some examples, the skirt second end comprises a skirt second end fastener engageable with the collar fastener to secure the collar to the skirt. The skirt second end fastener may comprise a skirt second end slot, and the collar fastener may comprise a collar tab insertable into the skirt second end slot to secure the skirt to the base.

In some examples, the skirt second end slot extends from the skirt first end to the skirt second end. The skirt can be adjustable in length by severing the skirt second end from a remainder of the skirt.

According to another broad aspect, a column assembly is provided. The column assembly comprises a sleeve having a first end portion, and a second opposed end portion. The column assembly further includes a collar having a collar aperture therethrough for receiving the first end portion of the sleeve in sliding fit. The column assembly further includes a base. At least one collar fastener is provided on the collar, and at least one base fastener is provided on the base. The collar fastener is engageable with the base fastener to secure the collar to the base.

In some examples, the collar fastener comprises a collar tab, the base fastener comprises a base slot, and the collar tab is insertable into the base slot to secure the collar to the base. The collar tab may extend outwardly from a first end of the collar, and the base slot may be defined in a second surface of the base. The collar tab can be snapably receivable in the base slot.

In some examples, the collar tab comprises a neck portion having a first neck end extending from the lower surface of the collar, and a second neck end opposed to the first neck end. The collar tab may further comprise a wedge portion extending from the neck portion. The wedge portion may have a first cross sectional area adjacent the second neck end, and a second cross sectional area spaced from the second neck end. The first cross sectional area may be larger than the second cross sectional area, and larger than a cross sectional area of the slot.

In some examples, the first end portion defines a first end face, and the first end face is seatable on the base when the first end portion is received in the collar aperture and the collar is mounted to the base. In some examples, the column assembly further comprises at least one end face fastener for securing the first end face to the base. In some examples, the first end face comprises at least one end face screw hole, the base comprises at least one base screw hole alignable with the end face screw hole, and the end face fastener comprises a screw receivable in the end face screw hole and the base screw hole.

In some examples, the column assembly further comprises at least one mounting connector for securing the base to a surface. The base may comprise at least one mounting screw hole extending therethrough from an upper surface thereof to a lower surface thereof, and the mounting connector may comprise a screw threadable through the mounting screw hole.

In some examples, the collar comprises eight collar fasteners, and the base comprises eight base fasteners, and each of the eight collar fasteners is engagable with one of the eight base fasteners.

In some examples, the column assembly further comprises a skirt. The skirt can comprise a first skirt end and a second opposed skirt end. A skirt aperture may extend through the skirt for receiving the first end portion of the sleeve in sliding fit. The first skirt end may be securable to the base. At least one skirt second end fastener may be provided on the skirt second end. The skirt second end fastener may be engageable with the collar fastener to mount the skirt second end to the collar.

In some examples, the skirt first end comprises a skirt first end screw port, the base comprises a base screw port, and a screw is provided for securing the skirt first end screw port to the base screw port.

In some examples, the skirt second end fastener comprises a skirt second end slot, the collar fastener comprises a collar tab, and the collar tab is insertable into the skirt second end slot to secure the collar to the skirt.

In some examples, the skirt second end slot extends from the first skirt end to the second skirt end. The skirt may be adjustable in length by severing the second skirt end from a remainder of the skirt.

According to another broad aspect, another column assembly is provided. The column assembly comprises a sleeve having a first end portion, and a second end portion opposed to the first end portion. The column assembly further comprises a collar having a collar aperture therethrough for receiving the first end portion of the sleeve in sliding fit. The collar comprises a collar fastener. The column assembly further comprises a skirt having a first skirt end and a second skirt end opposed to the first skirt end. The skirt has a skirt aperture extending therethrough for receiving the first end portion of the sleeve in sliding fit. The first end portion is receivable in the skirt aperture to position the second skirt end adjacent the collar. The skirt comprises a second skirt fastener provided on the second skirt end. The collar fastener is snapably engagable with the second skirt fastener to secure the skirt to the collar. A base is positionable adjacent the first end portion. The base is securable to the skirt second end.

In some examples the second skirt fastener comprises a second skirt slot, and the collar fastener comprises a collar tab extending downwardly from a lower surface of the collar and snapably receivable in the second skirt slot.

In some examples the second skirt slot extends from the first skirt end to the second skirt end. The skirt may be adjustable in length by severing the second skirt end from a remainder of the skirt.

BRIEF DESCRIPTION OF DRAWINGS

These and other features of the present invention will become more apparent from the following description in which reference is made to the appended drawings wherein.

DETAILED DESCRIPTION

Various apparatuses or processes will be described below to provide an example of an embodiment of each claimed invention. No embodiment described below limits any claimed invention and any claimed invention may cover processes or apparatuses that are not described below. The claimed inventions are not limited to apparatuses or processes having all of the features of any one apparatus or process described below or to features common to multiple or all of the apparatuses described below. It is possible that an apparatus or process described below is not an embodiment of any claimed invention. The applicants, inventors or owners reserve all rights that they may have in any invention disclosed in an apparatus or process described below that is not claimed in this document, for example the right to claim such an invention in a continuing application and do not intend to abandon, disclaim or dedicate to the public any such invention by its disclosure in this document.

Figure 1A:
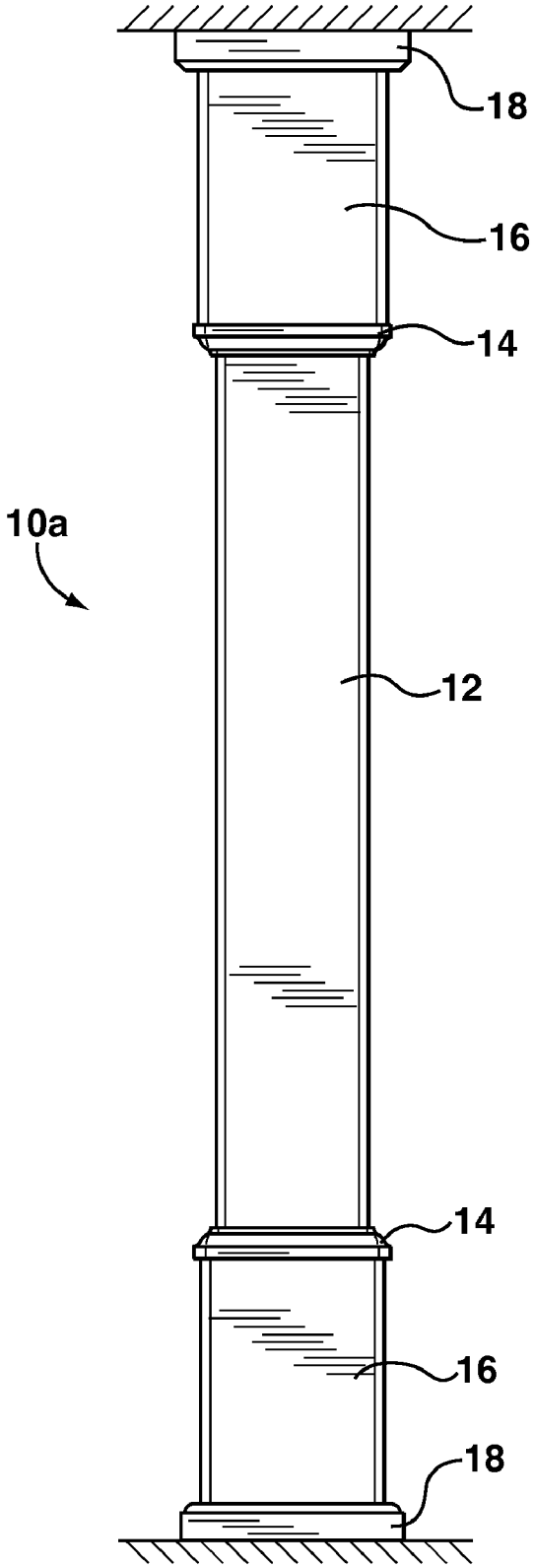
FIG. 1A is a front view of a column assembly assembled in a first configuration.
Figure 1B:
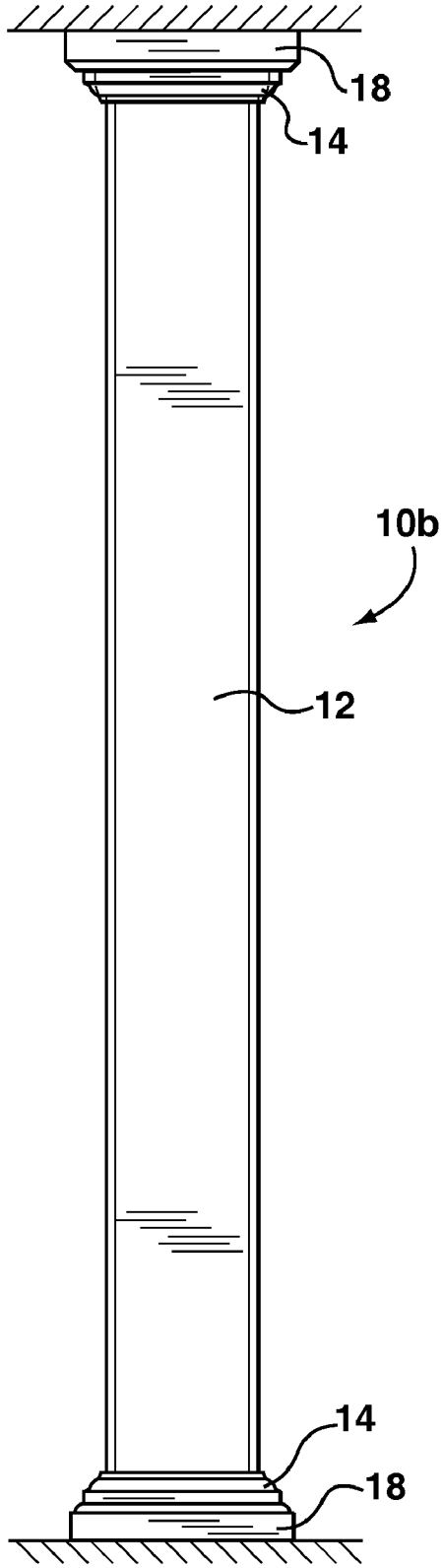
FIG. 1B is a front view of the column assembly of FIG. 1A, assembled in a second configuration.

Referring to FIGS. 1A and 1B, a first 10*a* and a second 10*b* configuration for a column assembly are shown. The column assembly can be selectively assembled in either the first configuration 10*a*, or the second configuration 10*b*, depending, for example, on the desired appearance of the column assembly. The column assembly may be provided as a kit of parts. The kit of parts may include each of the parts shown in FIG. 1A (as well as optional additional parts). The column assembly may be assembled using all of the parts, to create the first configuration 10*a*, or may be assembled using less than all the parts, to create the second configuration 10*b*.

In the example shown, the kit of parts includes a sleeve 12, two collars 14, two skirts 16, and two bases 18. The column assembly may be assembled using the sleeve 12, the collars 14, the skirts 16, and the bases 18, to create configuration 10*a*, or may be assembled using the sleeve 12, the collars 14, and the bases 18, without the skirts 16, to create configuration 10*b*.

The column assembly may alternately be assembled such that one end has the configuration shown in FIG. 1A (i.e. one end is assembled with a skirt), and the other end has the configuration shown in FIG. 1B (i.e. the other end is assembled without the skirt).

Figure 2:
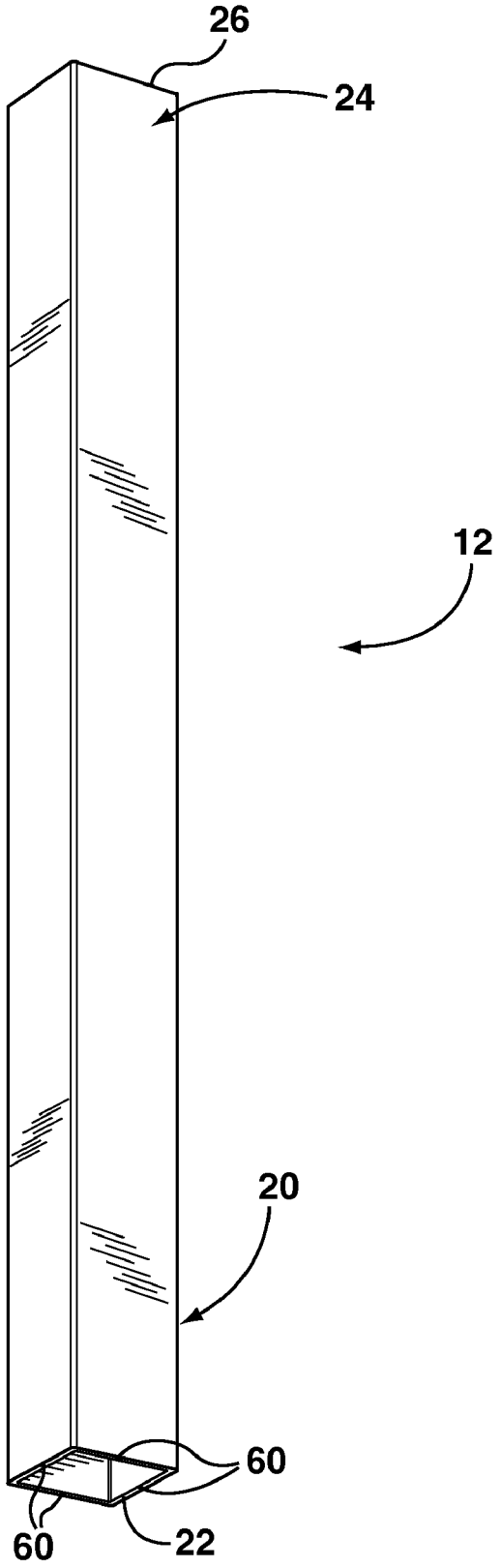
FIG. 2 is a perspective view of the sleeve of FIGS. 1A and 1B.

Referring to FIG. 2, the sleeve 12 is generally elongate, and has a first end portion 20 ending in a first end face 22, and a second end portion 24 opposed to the first end portion 20 and ending in a second end face 26. In the example shown, the sleeve 12 is hollow.

The sleeve 12 may accommodate a load-bearing shaft in its centre (not shown). The load-bearing shaft may, for example, be made of metal, such a standard high-adjustable circular steel column, or made of wood, such as a 4"×4" or two 2"×4" attached together.

In alternate examples, the sleeve 12 may be solid, or partially solid. The sleeve may take any suitable cross-sectional shape, such as, for example, square, rectangular, circular, hexagonal, octagonal.

In some examples, the sleeve 12 may be made from plastic, and may be manufactured by extrusion. In alternate examples, the sleeve 12 may be made from wood, stone, or metal, for example.

The description hereinbelow relates to the assembly of the various parts to the first end portion 20 the sleeve 12. That is, the description hereinbelow relates to the assembly of a collar 14, skirt 16, and base 18 to first end portion 20. However, it will be appreciated that the second end portion 24 of the sleeve 12 may be assembled to a collar 14, skirt 16, and base 18, in a similar manner as described hereinbelow.

Figure 3:
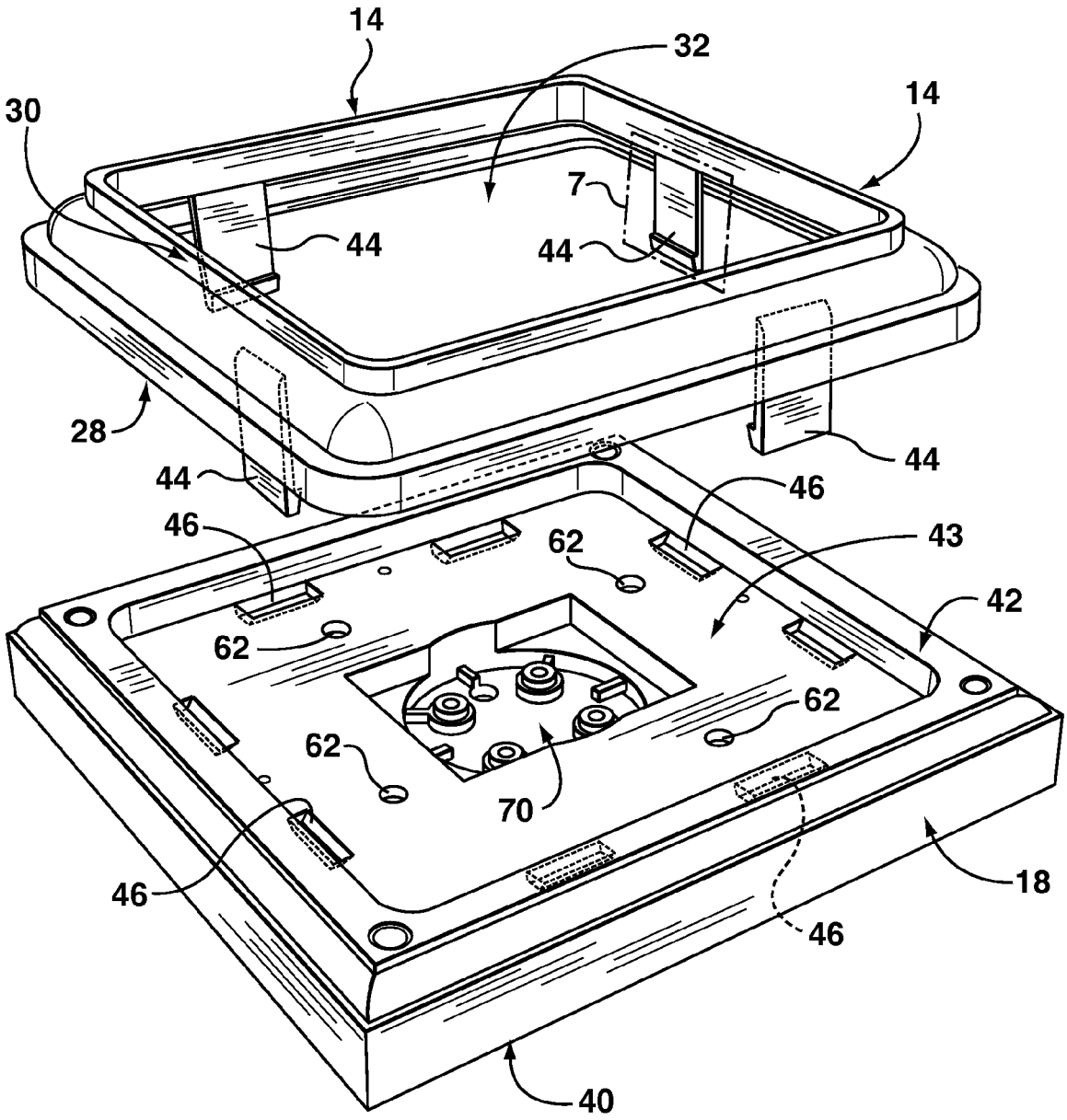
FIG. 3 is an exploded view of the collar and base shown in FIG. 1B.

Referring to FIG. 3, in the example shown, the collar 14 has a first end 28 and a second end 30 opposed to the first portion. A collar aperture 32 extends through the collar, from the first end 28 to the second portion 30, for receiving the first end portion 20 of the sleeve 12 in a sliding fit. That is, the first end portion 20 of the sleeve 12 is insertable into and through the aperture 28, and the aperture 28 is sized such that the sleeve 12 fits snugly therein, as shown in FIGS. 1A and 1B.

The collar 14 may be of various sizes and shapes. For example, as shown, the collar 14 may be generally square in cross section, to match the shape of the sleeve 12. Alternatively, the collar 14 may be another shape in cross section, for example rectangular, circular, hexagonal, octagonal, and may or may not match the shape of the sleeve 12.

In the example shown, the collar 14 decreases in cross sectional area going from the first end portion 28 to the second end portion 30 (i.e. is tapered). This may provide an aesthetic effect to the column assembly, by smoothing the transition from the sleeve 12 to the base 18 or the sleeve 12 to the skirt 16. In alternate examples, the collar 14 may not be tapered, or may include various other aesthetic features.

Figure 4:
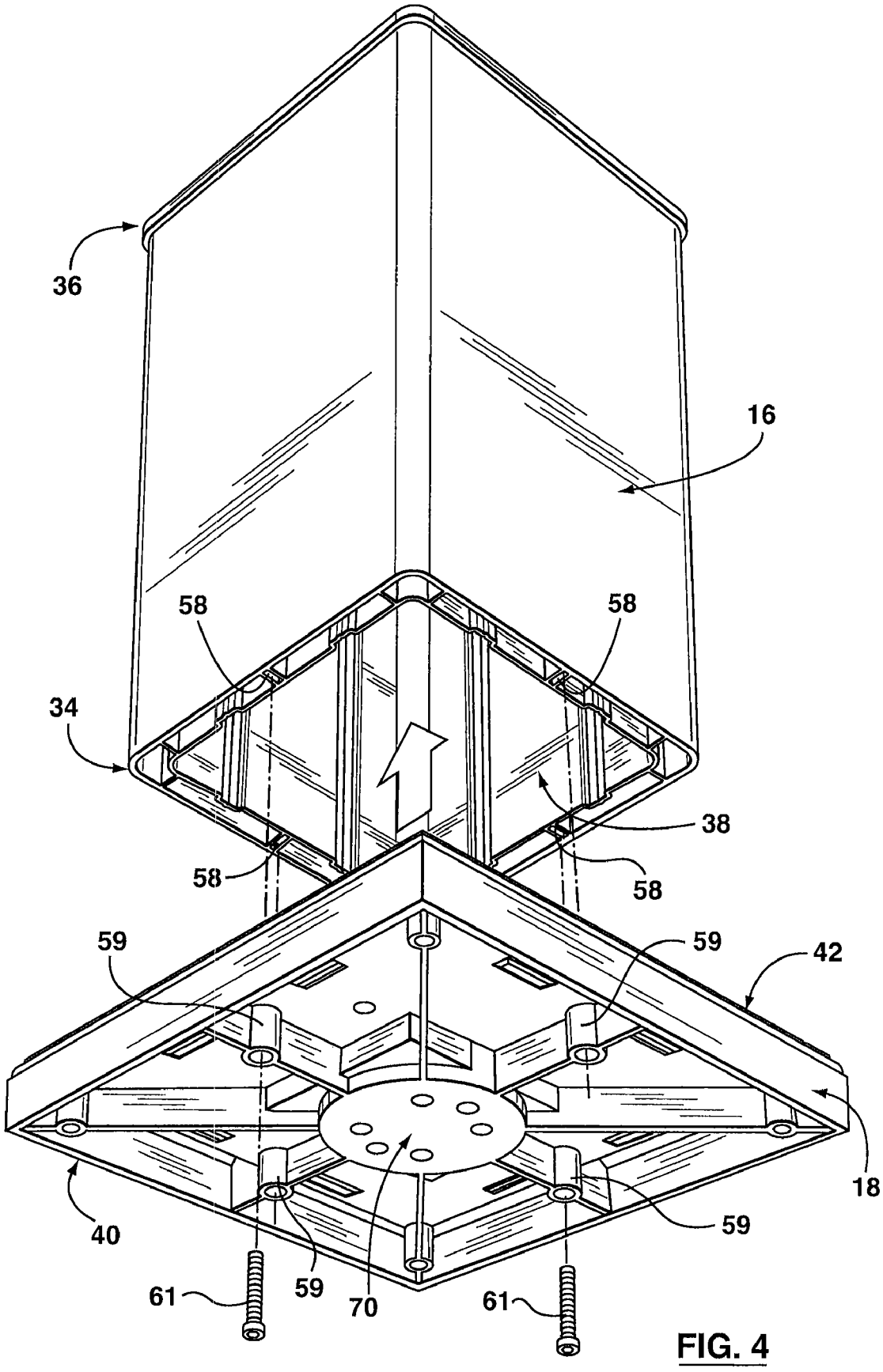
FIG. 4 is an exploded view of the skirt and base shown in FIG. 1A.

Referring to FIG. 4, in the example shown, the skirt 16 has a first skirt end 34 and a second skirt end 36 opposed to the first end portion. A skirt aperture 38 extends through the skirt, from the first skirt end 34 to the second skirt end 36, for receiving the first end portion 20 of the sleeve 12 in a sliding fit, as shown in FIG. 1A. That is, the first end portion 20 of the sleeve 12 is insertable into and through the aperture 38, such that the second skirt end is positioned adjacent the first collar end 28, and the skirt aperture is sized to snugly receive the sleeve 12.

The skirt 16 may be of various sizes and shapes. In the example shown, the skirt is generally elongate, and is square in cross section, to match the shape of the sleeve. In alternate examples, the skirt 16 may not be elongate and/or may be another shape in cross section, for example, rectangular, circular, hexagonal, octagonal, and may or may not match the shape of the sleeve 12.

Referring to FIGS. 3 and 4, in the example shown, the base 18 generally comprises a first base surface 40 and a second base surface 42 opposed to the first base surface. The first base surface 40 is seatable on a surface, for example a floor of a home, and the second base surface 42 is positionable adjacent the first end portion 20 of the sleeve 12. More specifically, the second base surface 42 is positionable adjacent and abutting the first end face 22 of the sleeve 12, such that the sleeve seats on the base. The base 18 is mountable to the sleeve 12, as will be described further hereinbelow. Further, the second base surface 42 is positionable adjacent either the first end of the skirt, as shown in FIG. 4, or the first end of the collar, as shown in FIG. 3, depending on the configuration of the column assembly.

In the example shown, the second base surface defines a recess 43. When the column assembly is assembled to create configuration 10*a*, the first end of the skirt may seat within recess 43. Alternately, when the column assembly is assembled to create configuration 10*b*, the first end of the collar may seat within recess 43.

The base may be of various shapes and sizes. In the example shown, the base 18 is generally flat and square in cross-sectional shape, in order to match the shape of the sleeve 12. In alternate examples, the base may not be flat (i.e. may be elongate), and may be another shape in cross section, such as, for example, rectangular, circular, hexagonal, octagonal, and may or may not match the shape of the sleeve 12.

As mentioned hereinabove, a load bearing shaft may be inserted into the sleeve 12.

Figure 5:
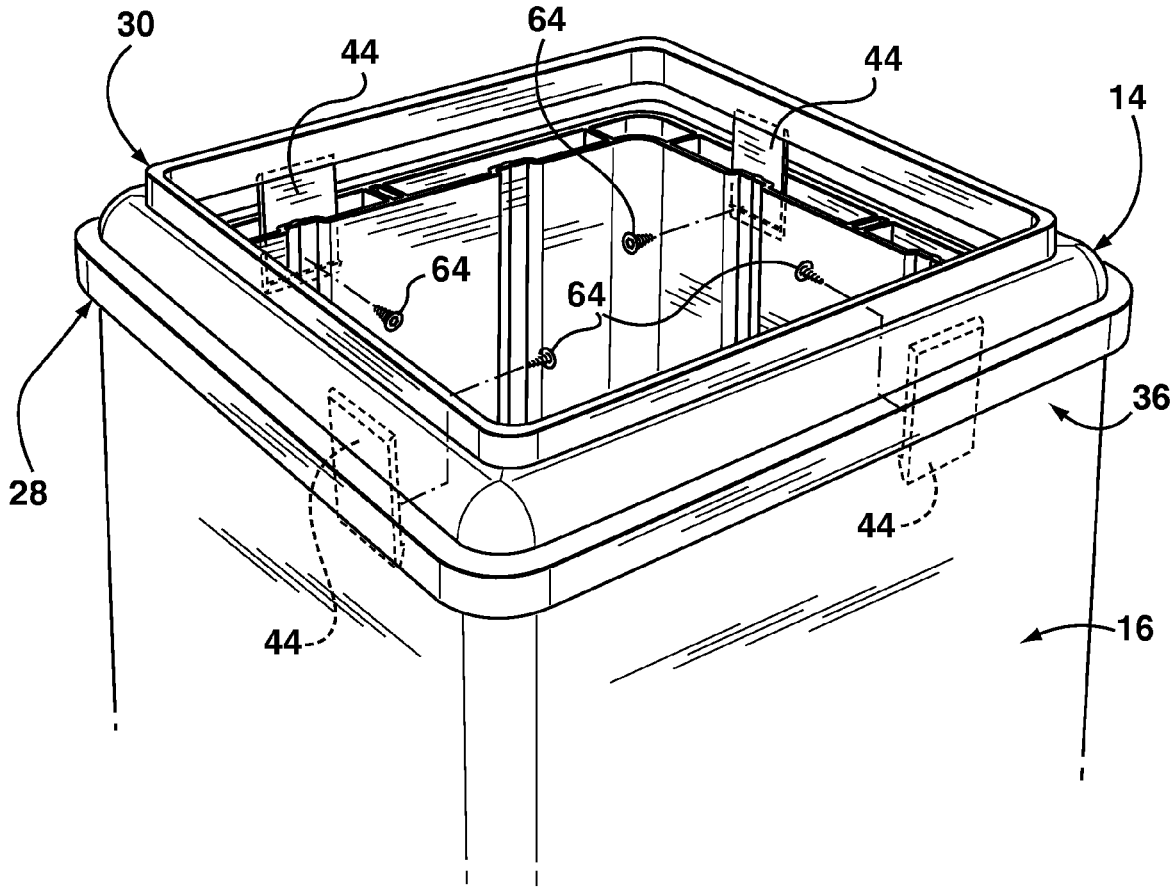
FIG. 5 is a partial perspective view of the collar and skirt shown in FIG. 1A.

In the example shown, the base comprises a mount 70 for securing to the load bearing shaft As mentioned hereinabove, the column assembly may be assembled using the sleeve 12, the collar 14, the skirt 16, and the base 18, to create configuration 10*a*, or may be assembled using the sleeve 12, the collar 14, and the base 18, without the skirt 16, to create configuration 10*b*. In order to provide the two configurations 10*a* and 10*b*, the collar 14 is selectively securable to the either the base 18, as shown in FIG. 3 or the second skirt end 36, as shown in FIG. 5, and the first skirt end 34 is selectively securable to the base 18, as shown in FIG. 4, such that the column assembly is selectively assemblable with or without the skirt 16.

To assemble the column assembly to create configuration 10*a*, the first end portion 20 of the sleeve 12 may be inserted into the collar aperture 32, from the second end 30 of the collar 14 to the first end 28 of the collar 14, and into the skirt aperture 38, from the skirt second end 36 to the skirt first end 34. The collar 14 may be secured to the skirt second end 36, as shown in FIG. 5, and the skirt first end 34 may be secured to the base 18, as shown in FIG. 4.

To assemble the column assembly to create configuration 10*b*, the first end portion 20 of the sleeve 12 may be inserted into the collar aperture 32, from the second end 30 of the collar 14 to the first end 28 of the collar 14, and the first end 28 of the collar may be secured to the second surface 42 of the base 18, as shown in FIG. 3. In both configurations, the first end face 22 of the sleeve 12 may be secured to the second surface 42 of the base 18.

Figure 6:
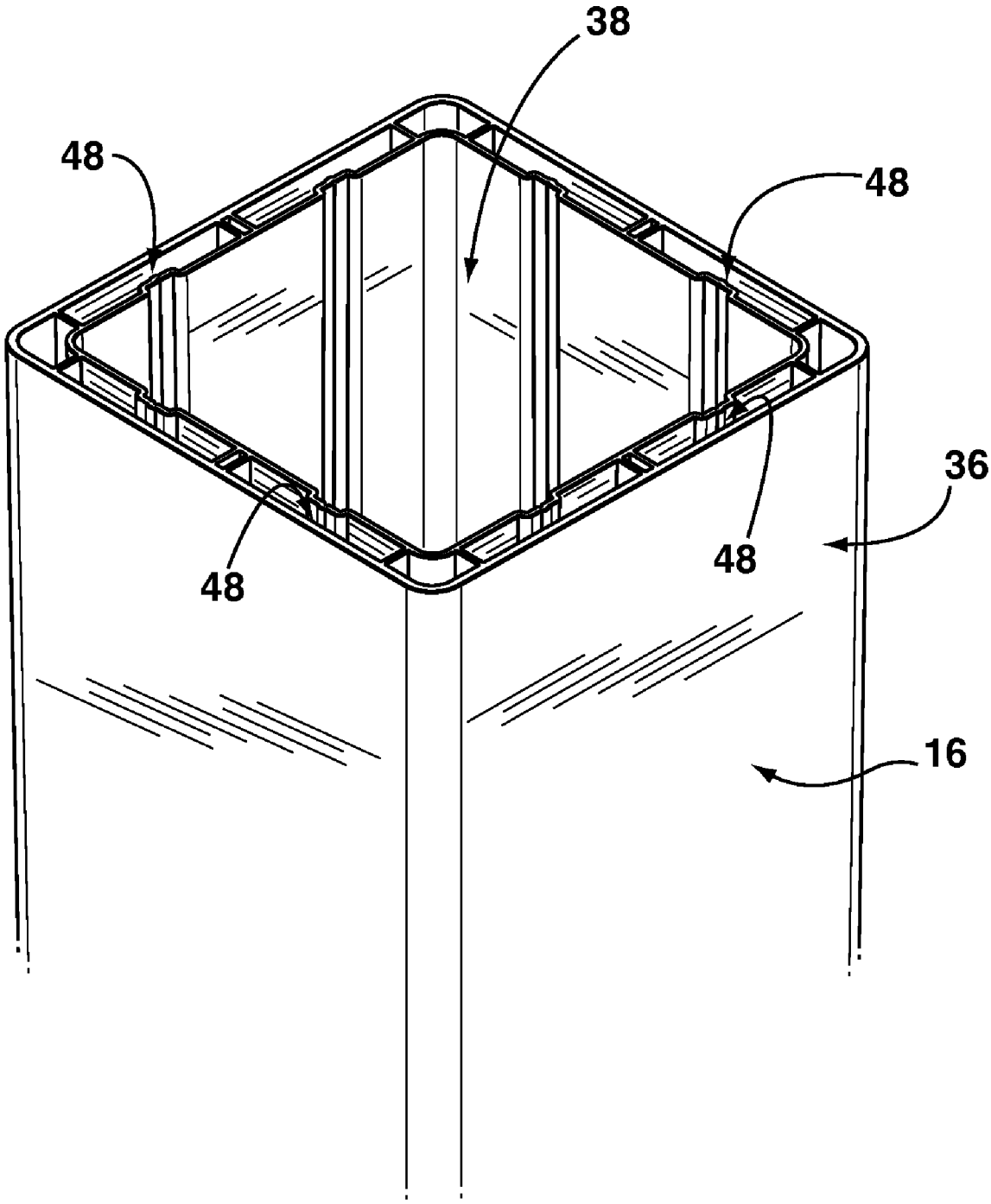
FIG. 6 is a partial perspective view of the skirt shown in FIG. 1A.

In order to selectively secure the collar 14 to the base 18 or the second skirt end 36, the collar 14 is provided with a collar fastener 44, as shown in FIG. 3, the base is provided with a base fastener 46, as shown in FIG. 3, and the second skirt end is provided with a second skirt end fastener 48, as shown in FIG. 6. The collar fastener 44 is engagable with the second skirt end fastener 48, to secure the collar 14 to the second skirt end 36, as shown in FIG. 5, to create configuration 10*a*, or the skirt 16 is omitted and the collar fastener 44 is engageable with the base fastener 46 to secure the collar 14 to the base 18, as shown in FIG. 3 to create configuration 10*b*.

In the example shown, the collar is provided with four collar fasteners 44, the base is provided with four base fasteners 46, and the second skirt end is provided with four second skirt end fasteners 48. However, in alternate examples, each of the collar 14, the base 18, and the second skirt end 36 may be provided with only one fastener, or with an alternate number of fasteners.

Referring to FIGS. 3, 5, and 6, in the example shown, the collar fasteners 44 are collar tabs 44, the base fasteners 46 are base slots 46, and the second skirt end fasteners are second skirt end slots 48. The collar tabs 44 are insertable into the base slots 46 to secure the collar 14 to the base 18, or into the second skirt end slots 48 to secure the collar 14 to the skirt 16.

Figure 7:
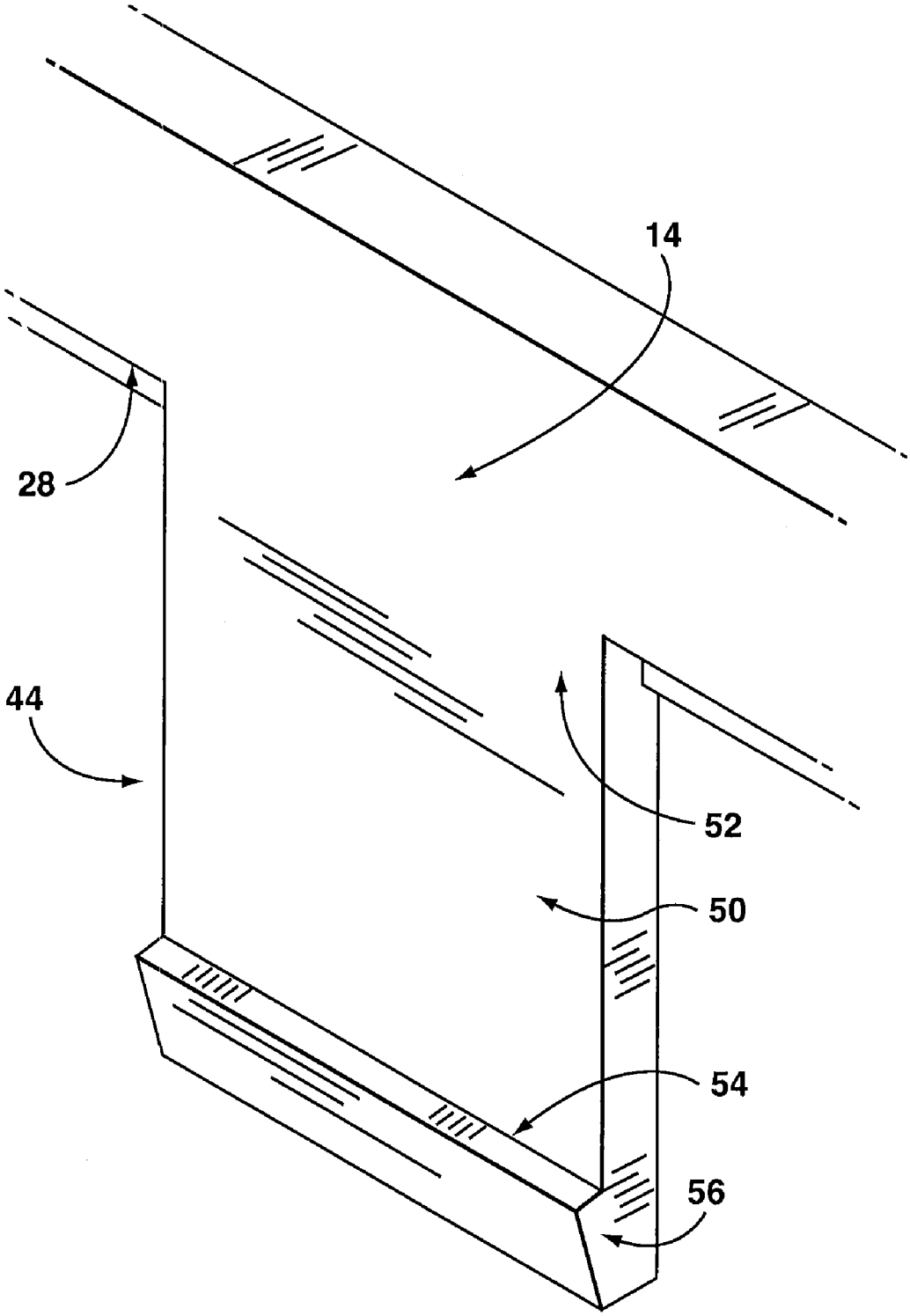
FIG. 7 is an enlarged perspective view of the collar tab shown in box 7 of FIG. 3.

Referring to FIG. 7, in the example shown, the collar tabs 44 extend outwardly from the first end 28 of the collar 14 (i.e. extend downwardly when the column assembly is assembled and the base is placed on a level surface), and are positioned such about the perimeter of the collar 14. Each collar tab 44 comprises a neck portion 50 having a first neck end 52 extending from the first end 28 of the collar 12, and a second neck end 54 opposed to the first neck end 50. A wedge portion 56 extends from the neck portion 50. The wedge portion 56 has a first cross sectional area adjacent the second neck end 54, and a second cross sectional area spaced from the second neck end 54. The first cross sectional area is larger than the second cross sectional area.

Referring to FIG. 3, in the example shown, the base slots 46 are defined in the second surface 42 of the base 18, and are positioned around the perimeter of the base 18, to align with the collar tabs 44. Similarly, as shown in FIGS. 5 and 6, the second skirt end slots 48 are positioned around the perimeter of the second skirt end 36, in order to align with the collar tabs 44. The base slots 46 and the second skirt end slots 48 are each sized to snapably receive a collar tab 44.

In the example illustrated, the base slots 46 and second skirt end slots 48 are sized such that the first cross sectional area of the wedge portion 56 is slightly larger than the cross sectional area of the slots 46 or 48, such that the tabs 44 and/or the slots 46 or 48 must deform slightly in order to insert the wedge portions 56 of the tabs into the slots 46 or 48.

A force can be applied to snap the wedge portions 56 into the slots 46 or 48. When the wedge portions 56 have been inserted into the slots the tabs 44 and/or the slots, 46 or 48 will spring back to their original shape, and thus the tabs 44 will be substantially locked or secured in the slots 44 or 46.

In alternate examples, a wedge portion 56 may not be provided, and snapping engagement of the collar 14, skirt 16, and base 18 may be provided in another manner. For example, the collar fasteners may comprise a tab having a flange, and the base fasteners and second skirt end fasteners may comprise a slot into which the flange is snapped.

In further alternate examples other types of fasteners may be used for engagement of the collar 14, base 18 and the skirt 16. For example, the fasteners may include adhesives, buttons, or screws.

In the example shown, the base fasteners 46 and the second skirt end fasteners 48 are substantially identical in shape, such that each may engage the collar fasteners 44. However, in alternate examples (not shown), the collar 14 may comprise a first set of fasteners for engaging the base fasteners, and a second set of fasteners for engaging the second skirt end fasteners. In such examples, the base fasteners and the second skirt end fasteners may not be identical in shape.

Referring to FIG. 5, in the example shown, a plurality of screws 64 are provided, for aiding in securing the collar 14 to the skirt 16. In alternate examples, such screws may not be required.

Referring to FIG. 4, in the example shown, in order to selectively secure the first skirt end 34 to the base 18, to create configuration 10*a*, the first skirt end 34 is provided with a first skirt end screw port 58, and the base is provided with base screw port 59 that is alignable with the first skirt end screw port. Further, a screw 61 is provided, for screwing the first skirt end to the base through the screw ports 58, 59. In the example shown, the first skirt end comprises four screw ports 58, which are positioned adjacent the corners of the skirt, the base comprises four screw ports 59, which are positioned adjacent the corners of the base, and four screws 61 are provided (only two screws 61 are shown). However, in alternate examples, another number of screw ports 58, 59, and screws 61 may be provided, and the screw ports 58, 59 may be otherwise positioned.

In alternate examples, the first skirt end 34 may be secured to the base 18 in another manner. For example, a different type connector, such as a rivet, or nail may be used to secure the first skirt end 34 to the base 18. In another example, the first skirt end may be provided with an fastener, which is engageable with a fastener on the base. For example, the first skirt end 34 may be provided with tabs extending downwardly therefrom, similar to tabs 44, which may engage the slots 46 on the base.

To assemble the column assembly to create configuration 10*a*, the first skirt end 34 is secured to the base 18, as shown in FIG. 4, the collar 14 is secured to the second skirt end 36, as shown in FIG. 5, and the first end portion 20 of the sleeve 12 is inserted into the collar aperture 32 and the skirt aperture 38 (in any order). Alternatively, to assemble the column assembly to create configuration 10*b*, the skirt 16 is omitted and the collar fasteners 44 are engaged with the base fasteners 46, as shown in FIG. 3, and the first end portion 20 of the sleeve 12 is inserted into the collar aperture 32 (in any order).

In some examples, the skirt 16 may be configured such that it is adjustable in length, so that a user may customize the appearance of the column assembly. For example, the skirt 16 may be manufactured such that the second skirt end slots 48 extend along the entire length of the skirt 16, from the first skirt end 34 to the second skirt end 36, or along a substantial portion of the length of the skirt 16. Further, the first skirt end screw ports 58 may extend along the entire length of the skirt 16, from the first skirt end 34 to the second skirt end 36, or along a substantial portion of the length of the skirt 16. In order to customize the length of the skirt 16, a user may sever the skirt second end 36 from the remainder of the skirt. For example, a user may saw off the top two-thirds of the skirt 16. As the second skirt end slots 48 extend along the entire length or a substantial portion of the skirt 16, the slots will remain in the severed face of the remainder of the skirt. Accordingly, the collar 14 may be mounted to the remainder of the skirt, and the remainder of the skirt may be mounted to the base 18. Alternately, in order to customize the length of the skirt 16, a user may sever the skirt first end 34 from the remainder of the skirt. For example, a user may saw off the bottom two-thirds of the skirt 16. As the first skirt end screw ports 58 extend along the entire length or a substantial portion of the skirt 16, the screw ports will remain in the severed face of the remainder of the skirt. Accordingly, the collar 14 may be mounted to the remainder of the skirt, and the remainder of the skirt may be mounted to the base 18.

As mentioned hereinabove, in both configurations 10*a* and 10*b*, the first end face 22 of the sleeve 12 may be secured to the second surface 42 of the base 18. For example, an end face fastener (not shown) may be provided for securing the first end face 22 to the second base surface 42. Referring to FIG. 2, in the example shown, the first end face comprises a plurality of screw holes 60 extending inwardly into the first end portion 20. Further, as shown in FIG. 3, the base comprises a plurality of screw holes 62 extending therethrough, from the first surface 40 to the second surface 42, which are alignable with the screw holes 60 when the first end face 22 of the sleeve 12 is positioned on the base 18. A screw may be screwed through each of the screw holes 62 in the base and into each of the screw holes in the sleeve 12, to secure the sleeve 12 to the base 18.

Figure 8:
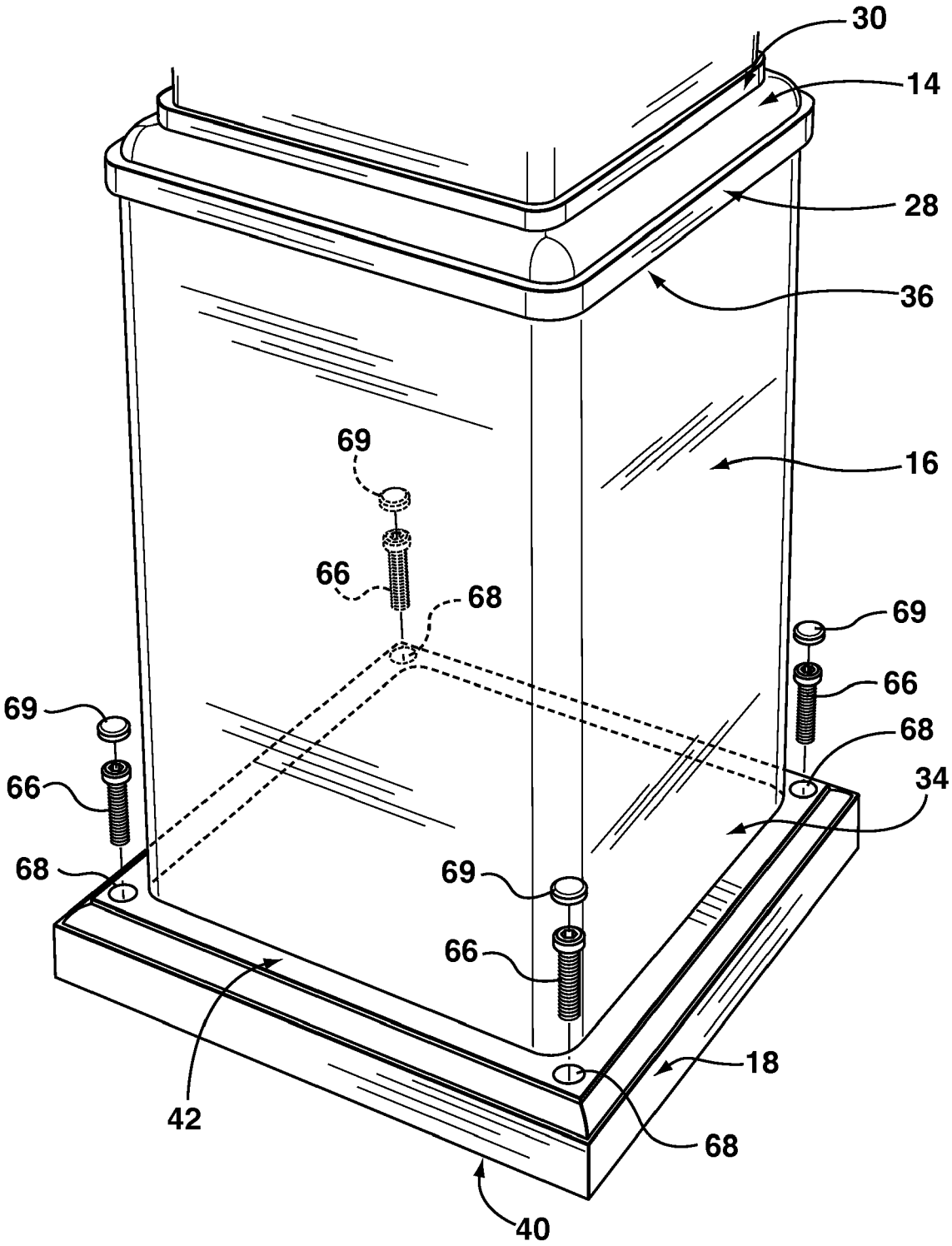
FIG. 8 is a partial perspective view of the sleeve, collar, base, and skirt of FIG. 1A.

As mentioned hereinabove, the first base surface 40 is seatable on a surface, for example a floor or a ceiling of a home. Further, the first base surface 40 may be fixedly mounted to the surface, to secure the column assembly in place. For example, at least one mounting connector 66 may be provided for mounting the base to the surface. For example, as shown in FIG. 8, the base comprises a plurality of mounting screw holes 68 extending therethrough, from the first base surface 40 to the second base surface 42. A screw 66 may be screwed through the mounting screw holes and into the surface to mount the column assembly to the surface. Further, a cap 69 may be placed over the screw heads, to provide an aesthetic effect.

As mentioned hereinabove, in some examples, a kit of parts for a column assembly may be sold including a sleeve, two collars 14, two skirts 16, and two bases 18. Alternately, in some examples, a kit of parts may be sold including a sleeve 12, one collar 14, one skirt 16, and one base 18.

As mentioned hereinabove, a kit of parts for a column assembly may be sold including a sleeve 12, one or more collars 14, one or more skirts 16, and one or more bases 18, and a user may elect to assemble the column assembly with or without the skirt(s) 16. Alternatively, the kit of parts may be sold without the skirt(s), and may only include sleeve 12, one or more collars 14, and one or more bases 18. Accordingly, a user may elect to purchase skirt(s) 16 separately, or not to purchase skirt(s) 16 at all.

As mentioned hereinabove, in the example shown, the column assembly can be selectively assembled in either the first configuration 10*a*, or the second configuration 10*b*, by snapably assembling the various parts together. In alternate examples, the column assembly may be sold such that it is only snapably assemblable in the first configuration 10*a*. That is, it may be advantageous to provide a column assembly that can be snapably assembled together, without being selectively assemblable.

It will be appreciated that, in some examples, the column assembly may be provided as a kit ready to be assembled. In alternate examples, the kit may be provided in an assembled configuration.

I claim:

1. A kit of parts for a column assembly comprising:

a) a sleeve comprising a first end portion, and a second opposed end portion;

b) a collar comprising a collar aperture therethrough for receiving the first end portion of the sleeve in sliding fit;

c) a skirt comprising a skirt first end and a skirt second end opposed to the skirt first end, and a skirt aperture extending through the skirt for receiving the first end portion of the sleeve in sliding fit to position the skirt second end adjacent the collar; and d) a base positionable adjacent the first end portion;

e) the collar being securable to the base in a first configuration of the column assembly and to the skirt second end in a second configuration of the column assembly, and the skirt first end being securable to the base in the second configuration of the column assembly and wherein the collar comprises a collar fastener, the base comprises a base fastener, and the collar fastener is engageable with the base fastener to secure the collar to the base; and wherein the skirt second end comprises a skirt second end fastener engageable with the collar fastener to secure the collar to the skirt, wherein the skirt second end fastener comprises a skirt second end slot and the collar fastener comprises a collar tab insertable into the skirt second end slot to secure the skirt to the base, and wherein the skirt second end slot extends from the skirt first end to the skirt second end.

2. The kit of parts of claim 1, wherein the base fastener comprises a base slot, and the collar tab is insertable into the base slot to secure the collar to the base.

3. The kit of parts of claim 2, further comprising a connector for securing the skirt first end to the base.

4. The kit of parts of claim 3, wherein:

a) the skirt first end comprises a skirt first end screw port;

the base fastener comprises a base screw port; and the connector comprises a screw insertable through the skirt first end screw port and the base screw port.

5. The kit of parts of claim 4, wherein the skirt first end screw port extends from the skirt first end to the skirt second end.

6. The kit of parts of claim 5, wherein an axial length of the skirt is adjustable from an initial length to a shortened length by severing the skirt adjacent at least one of the skirt first end and the skirt second end, the skirt first screw port and skirt second end slot disposed adjacent the respective skirt first end and skirt second end of the shortened length skirt.

7. The kit of parts of claim 1, wherein the skirt second end is severable from a remainder of the skirt.

8. A column assembly comprising:

a) a sleeve having a first end portion adjacent a first end face, and a second opposed end portion spaced apart along an axis;

b) a collar having a collar aperture therethrough for receiving the first end portion of the sleeve in sliding fit;

c) a base positionable against the first end face;

d) at least one collar fastener provided on the collar, and at least one base fastener provided on the base, the collar fastener being engageable with the base fastener to secure the collar to the base; and e) a skirt having a skirt first end and a skirt second end axially spaced apart from the first skirt end, a skirt aperture extending through the skirt for receiving the first end portion of the sleeve in sliding fit, the skirt first end securable to the base, and at least one skirt second end fastener provided on the skirt second end, the skirt second end fastener engageable with the collar fastener to mount the skirt second end to the collar, wherein the skirt second end fastener comprises a skirt second end slot, the collar fastener comprises a collar tab, and the collar tab is insertable into the skirt second end slot to secure the collar to the skirt;

wherein the skirt first end comprises a skirt first end screw port, the base comprises a base screw port, and a screw is insertable through the skirt first end screw port and the base screw port.

9. The column assembly of claim 8, wherein the collar tab comprises:

a) a neck portion having a first neck end extending from the lower surface of the collar, and a second neck end opposed to the first neck end; and a wedge portion extending from the neck portion, the wedge portion having a first cross sectional area adjacent the second neck end, and a second cross sectional area spaced from the second neck end, the first cross sectional area being larger than the second cross sectional area.

10. The column assembly of claim 9, wherein the first cross sectional area is larger than a cross sectional area of the slot.

11. The column assembly of claim 8, wherein the first end face is seatable on the base when the first end portion is received in the collar aperture.

12. The column assembly of claim 11, further comprising at least one end face fastener for securing the first end face to the base.

* * * * *